US006753834B2

(12) United States Patent
Mikami et al.

(10) Patent No.: US 6,753,834 B2
(45) Date of Patent: Jun. 22, 2004

(54) DISPLAY DEVICE AND DRIVING METHOD THEREOF

(75) Inventors: Yoshiro Mikami, Hitachiota (JP); Yoshiharu Nagae, Hitachi (JP); Toshihiro Sato, Mobara (JP); Yoshiyuki Kaneko, Hachioji (JP); Shosaku Tanaka, Tottori (JP)

(73) Assignee: Hitachi, Ltd., Tokyo (JP)

( * ) Notice: Subject to any disclaimer, the term of this patent is extended or adjusted under 35 U.S.C. 154(b) by 176 days.

(21) Appl. No.: 09/933,807

(22) Filed: Aug. 22, 2001

(65) Prior Publication Data

US 2002/0140659 A1 Oct. 3, 2002

(30) Foreign Application Priority Data

Mar. 30, 2001 (JP) ..... 2001-098863

(51) Int. Cl.[7] ..... G09G 3/30
(52) U.S. Cl. ..... 345/76; 345/82; 345/90
(58) Field of Search ..... 345/76, 78, 79, 345/82, 87, 90, 91, 92; 340/815.45

(56) References Cited

U.S. PATENT DOCUMENTS 5,977,940 A * 11/1999 Akiyama et al. ..... 345/94
6,169,532 B1 * 1/2001 Sumi et al. ..... 345/98
6,525,709 B1 * 2/2003 O'Callaghan ..... 345/98

* cited by examiner

*Primary Examiner*—Dennis-Doon Chow
(74) *Attorney, Agent, or Firm*—Antonelli, Terry, Stout & Kraus, LLP

(57) ABSTRACT

In an active matrix display device utilizing electro-optical elements such as organic EL elements capable of obtaining a high image quality with a low power, each pixel circuit is provided with: a sampling circuit for sampling a signal voltage on a signal wiring line synchronously with a scan pulse; a reference voltage; and a comparator circuit. In the pixel circuit, the sampled signal voltage is compared with the reference voltage and the display time of each EL device is controlled by the period until the relation between the signal voltage and reference voltage is inverted, to thereby control the light emission time in one frame period.

21 Claims, 13 Drawing Sheets

DISPLAY DEVICE AND DRIVING METHOD THEREOF

BACKGROUND OF THE INVENTION

The present invention relates to an organic EL display device capable of gray scale display by varying a duty ratio, a display device capable of binary display such as liquid crystal and FED, and to their drive method.

An organic EL display device of an active matrix type is a self luminescence display device characterized in high efficiency, high luminance and a wide viewing angle. Practical applications of such organic EL display devices are being developed. In order to realize gray scale display, an analog memory and a voltage-current conversion circuit are provided in each pixel circuit, and an organic EL element drive current is controlled by the voltage in the analog memory. However, there is a large variation in transistor characteristics so that a variation in emission luminance is large and display luminance is irregular, resulting in a difficulty of improving the image quality. In a digital display drive method, EL devices are controlled to take either an on-state or an off-state by using a pixel switch transistor.

This technique is detailed in JP-A-08-241048. Each pixel circuit has a digital memory made of one TFT and one capacitor, the on/off state of the organic EL devices are controlled by an output from the memory. This technique has considerably improved the luminance uniformity in the pixel on-state.

With the display device of this type, one frame period is divided into a plurality of sub-field periods, and a predetermined display period starts after scanning one frame to control the on/off state of each pixel. This operation is repeated to realize gray scale display of each pixel. If a large scale matrix is used, the wiring delay to be caused by wiring resistance and capacitance becomes considerably large, so that the necessary scan time for each sub-field prolongs and the display time becomes insufficient. In order to improve display luminance, it is necessary to use a large current operating point which provides a low light emission efficiency of EL, resulting in a possibility of an increase in the panel power consumption. If the panel is made large, the wiring delay increases considerably, and the frame period prolongs. In this case, flicker and the like occur and the performance of moving image display lowers.

SUMMARY OF THE INVENTION

According to the conventional technique described above, organic EL devices of a pixel circuit are driven to have a binary state in order to remove a variation in display luminance. In order to obtain gray scale drive, one frame period is divided into a plurality of sub-field periods. All pixels are scanned in each sub-field period to write binary display data corresponding each gray scale level bit, and during the display period, each pixel is turned on at a predetermined luminance and for a predetermined time.

If the number of gray scale levels is increased to improve the image quality, the number of sub-fields increases and the scan frequency becomes high. For example, if a display device having 640×480 pixels is driven at an 8-bit gray scale level, a frame frequency of 60 Hz, a horizontal blanking period of 20%, and a display period of a half of one sub-field period, then the scan frequency is 60×480×1.2×8×2=552 kHz and one horizontal scan period is 1.8 μsec. As compared to a scan frequency of the analog drive type is 34.6 kHz, an operation speed 16 times faster is required.

Therefore, as compared to the analog drive type pixel, a wiring delay to be caused by wiring resistance and capacitance in a pixel circuit is required to be reduced further by considerably lowering the wiring resistance and capacitance. It is therefore necessary to thicken wiring lines and interlayer insulating films, which results in a low manufacture yield, a complicated process and an increased cost. If high precision and the increased number of gray scale levels are to be realized for improving the image quality or if the display device is made large, the scan frequency becomes higher so that a high image quality and a large screen display device are difficult. An increase in the scan frequency results in an increase in a circuit power consumption and a necessity of using a high speed signal processing circuit, so that a heat generation amount of the panel increases.

In consideration of the above-described problems associated with the conventional technique, it is an object of the present invention to provide a display device and its driving method capable of gray scale display at a high precision and reduction of a power loss.

In order to achieve the above object of the invention, an on/off of each pixel is controlled in order to make display luminance of pixels uniform, and in order to effectively use the display period, gray scale control is realized by controlling the ratio of turn-on time to the frame period of each pixel not by using sub-fields of conventional technique.

To this end, according to a first aspect of the invention, each pixel is provided with a signal sampling circuit, a time constant circuit or constant current circuit and a voltage comparator circuit. The signal sampling circuit is made of a transistor and a capacitor, and samples an analog signal voltage corresponding to display luminance. The time constant circuit or constant current circuit changes the sampled signal voltage with time. The voltage comparator circuit compares a continuously changing sampled voltage with a comparison reference voltage to judge an amplitude state of both the voltages.

According to a second aspect of the invention, in addition to the circuits described above, each pixel is provided with a reference voltage sampling circuit, a time constant circuit or constant current circuit and a voltage comparator circuit. The reference voltage sampling circuit samples a reference voltage. The time constant circuit or constant current circuit changes the reference voltage with time. The voltage comparator circuit compares a continuously changing sampled reference voltage with the sampled signal voltage to judge which one of both the voltages is higher.

According to a third aspect of the invention, each pixel is provided with a signal sampling circuit and a reference voltage sampling circuit. The signal sampling circuit is made of a transistor and a capacitor, and samples an analog signal voltage corresponding to display luminance. The reference voltage sampling circuit samples a reference voltage. A reference voltage capacitor sampled the reference voltage is coupled between the reference voltage and a voltage comparator circuit so that the voltage comparator circuit compares a difference voltage from the sampled reference voltage with the sampled signal voltage.

With the first to third aspects of the invention, driving the pixel circuit is controlled to control the ratio of a turn-on time.

In the first aspect of the invention, a signal voltage is sampled at a pixel selected by a scan line under line-at-a-time scan. The signal voltage at the end of the selection period sampled in the capacitor lowers with time in the time constant circuit. The voltage comparator circuit compares the sampled voltage with the reference voltage. A control voltage at the output terminal of the voltage comparator circuit changes when the amplitude state of both the voltages is inverted. The control voltage controls the conductive/non-conductive state of the main circuit of an EL driver circuit. Only while the main circuit is conductive, the organic EL devices of the pixel circuit are turned on.

In the second aspect of the invention, a signal voltage and a reference voltage are sampled at a pixel selected by a scan line under line-at-a-time scan. The reference voltage at the end of the selection period sampled in the capacitor lowers with time in the time constant circuit. The voltage comparator circuit compares the signal voltage with the reference voltage. A control voltage at the output terminal of the voltage comparator circuit changes when the amplitude state of both the voltages is inverted. Specifically, when the reference voltage is lower than the signal voltage, the comparator output is inverted. The control voltage controls the conductive/non-conductive state of the main circuit of an EL driver circuit. Only while the main circuit is conductive, the organic EL devices of the pixel circuit are turned on.

In the third aspect of the invention, a signal voltage and a reference voltage are sampled at a pixel selected by a scan line under line-at-a-time scan. The reference voltage at the end of the selection period sampled in the capacitor is inserted between the reference voltage wiring line and the input terminal of the voltage comparator circuit. In this case, this connection inverts the polarity of the voltage relative to the voltage comparator circuit. Therefore, a relative reference voltage corresponding to the reference voltage input terminal voltage of the voltage comparator circuit immediately after the selection period is generally 0. Thereafter, this voltage at the input terminal changes relatively in accordance with a voltage change on the reference wiring line. The voltage comparator circuit compares the signal voltage with the relative reference voltage. A control voltage at the output terminal of the voltage comparator circuit changes when the sign of subtraction between both the voltages is inverted. The main circuit of an EL driver circuit is made conductrive and non-conductive by the control voltage. Only while the main circuit is conductive, the organic EL devices of the pixel circuit are turned on.

According to the present invention, a pixel circuit uses organic EL devices and has a built-in comparator circuit. Accordingly, the light emission time of each pixel can be controlled so that even if the characteristics of transistors constituting the pixel circuit vary, a variation in luminance is small and a display device capable of gray scale display at a high precision can be provided. Since a pixel power consumption depends on the on/off state of OLED, the drain power loss of the transistor can be reduced and a display device capable of high efficiency and low power consumption can be realized.

In the pixel circuit with the comparator circuit, a time constant circuit is used so that the circuit structure can be made simple. The number of components is therefore small and a display device with a high precision can be provided. In the structure that an external triangular wave is applied to compare it with a sampled voltage in the pixel and control the light emission time, the light emission time can be controlled at a high precision and this structure is effective for multi-level gray scale.

DETAILED DESCRIPTION OF THE EMBODIMENTS

Embodiments of the invention will be described in detail with reference to the accompanying drawings.

(1st Embodiment)

Figure 1:
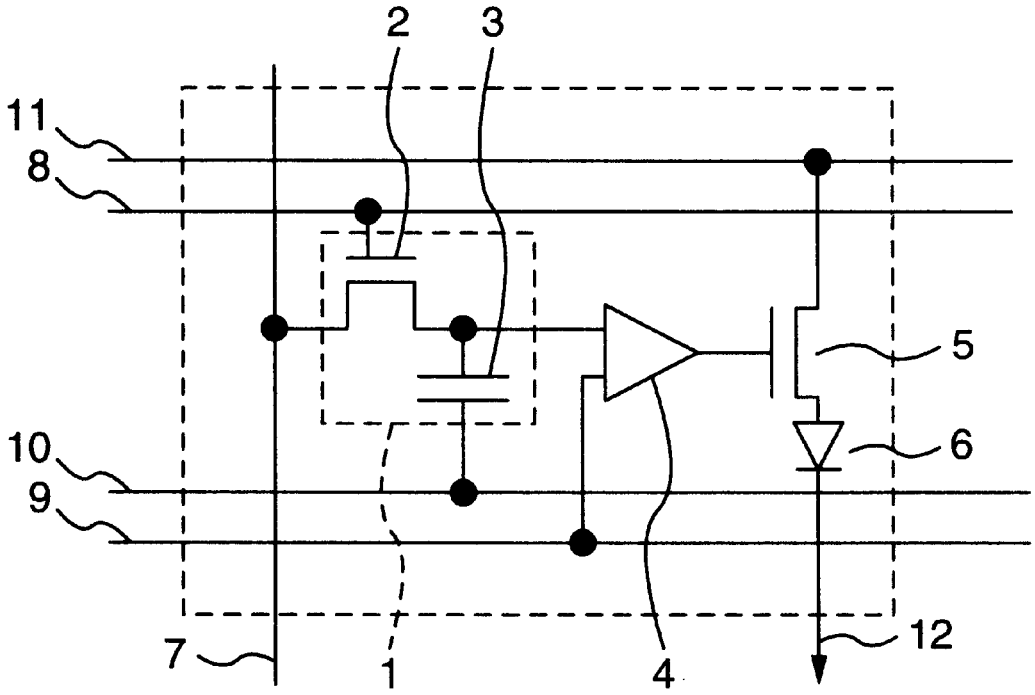
FIG. 1 is a circuit diagram showing the structure of a pixel circuit according to a first embodiment of the invention.

FIG. 1 shows the fundamental structure of a pixel circuit of a display device according to the first embodiment of the invention. The pixel circuit has a signal voltage sampling capacitor 3 and a signal sampling TFT 2, and is constituted of a signal sampling circuit 1 for sampling a signal voltage, a comparator 4, a reference voltage wiring line 9 an OLED power supply wring line 11 for driving an OLED driver circuit (transistor) 5, an OLED 6, an OLED common electrode wiring line 12 for connection to an unrepresented OLED common electrode, a scan wiring line 8 for controlling a sampling operation, a signal wiring line 7 for supplying a video signal, and a common wiring line 10 for supplying a ground potential. The display device has a plurality of such pixel circuits disposed in a matrix shape.

Figure 2:
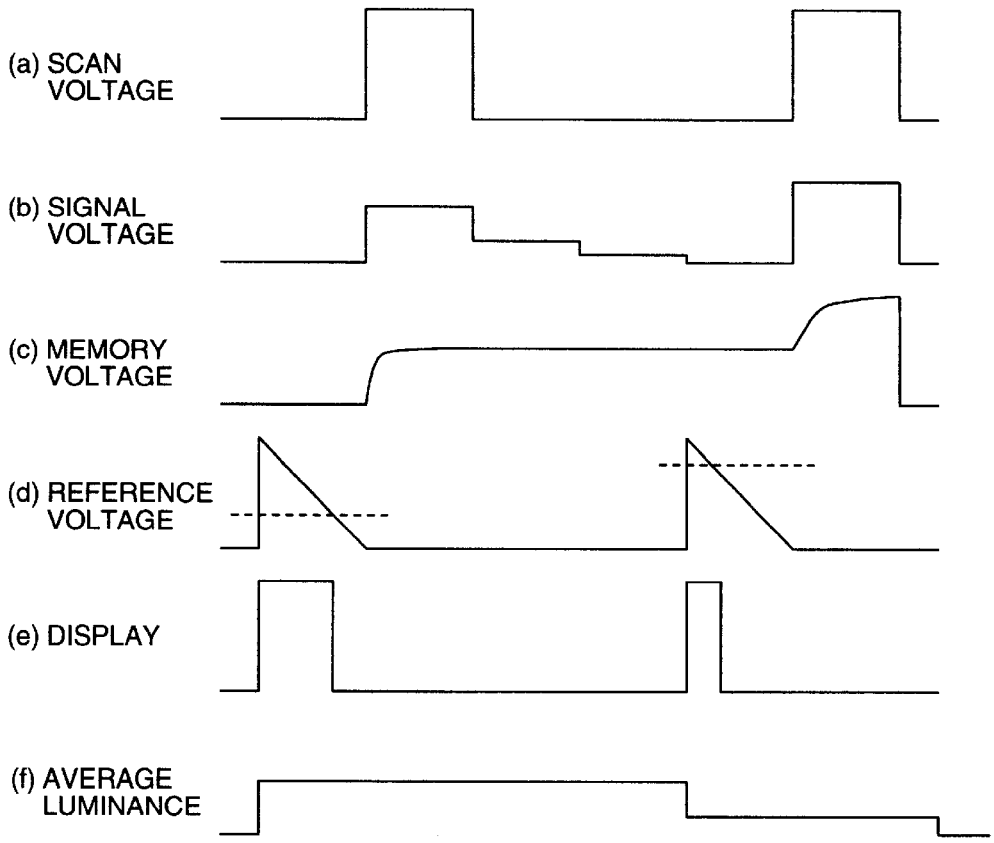
FIGS. 2(*a*) to 2(*f*) are diagrams showing the waveforms of signals driving the pixel circuit of the first embodiment.

FIGS. 2(*a*) to 2(*f*) show the waveforms of signals driving the pixel circuit. As each scan wiring line 8 is sequentially selected from the upper line to the lower line, a scan voltage is applied to the sampling circuit 1. In this sampling circuit 1, a signal voltage supplied via the signal wiring line 7 is charged in the sampling capacitor 3 as a memory voltage. The memory voltage is maintained in the sampling capacitor 3 until the next scan voltage is supplied. After the scan period of one frame is terminated, the scan period starts and a sawtooth voltage such as shown in FIG. 2(*d*) is applied to the reference voltage wiring line 9. An output voltage of the comparator 4 changes depending upon which one of the voltages applied to the input terminals of the comparator 4 is higher. In this circuit, the memory voltage of the sampling circuit 1 is applied to one input terminal, and the reference voltage wiring line is connected to the other input terminal. The memory voltage proportional to the signal voltage maintains constant during one frame period and the reference voltage changes during the display period. Therefore, as the signal voltage range changes in the reference voltage range, amplitudes of the reference voltage and memory voltage take an inverted relation at corresponding timings during the display period.

It is therefore possible to make the comparator output a pulse during a corresponding period in the display period. The OLED driver circuit (transistor) 5 is connected to the output of the comparator 4. While the output voltage of the comparator 4 takes a high level, the OLED driver circuit 5 turns on and OLED turns on. It is possible to control to make OLED turn on during a predetermined time in the display period so that gray scale display is possible. With this method, the circuit structure is simple. If TET's are used for controlling all the pixel circuits, the display device can be fabricated on a glass substrate. If the circuits are fabricated on an Si wafer, as compared to TFT's fabricated on a glass substrate, fine patterning becomes possible and a compact and high precision panel of a light emission type can be realized.

(2nd Embodiment)

Figure 3:
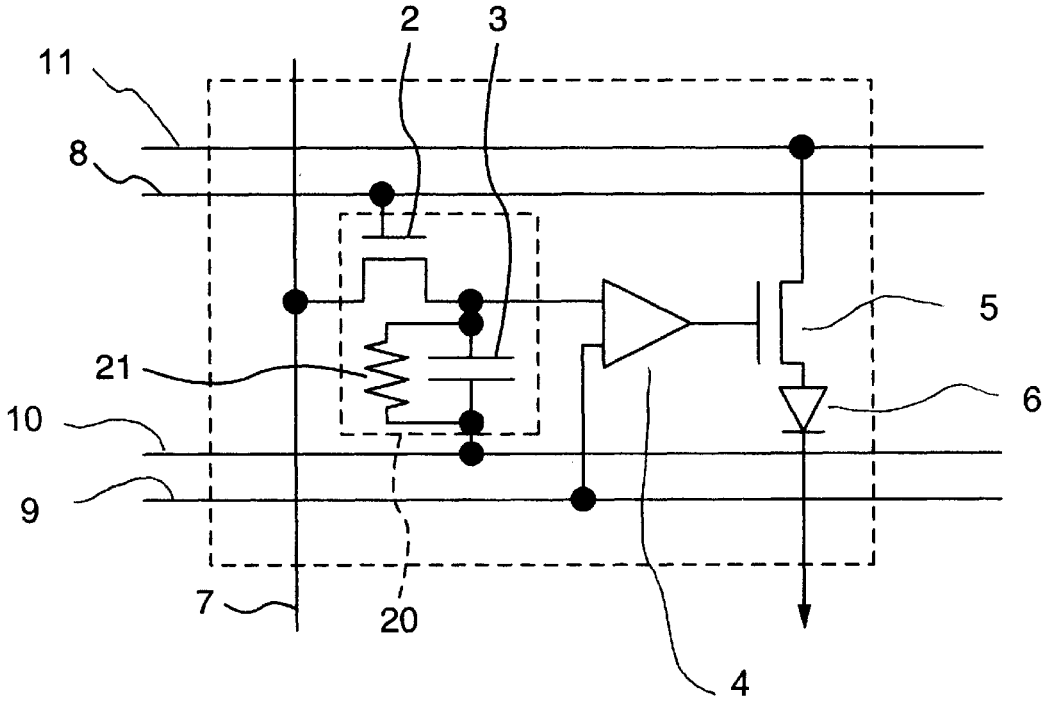
FIG. 3 is a circuit diagram showing the structure of a pixel circuit with a time constant circuit according to a second embodiment of the invention.

The second embodiment will be described with reference to FIG. 3. In this embodiment, a time constant circuit is provided in a signal voltage sampling circuit 20 of the pixel circuit. The waveform of a memory voltage, therefore, changes with time so that the light emission time can be controlled and gray scale control can be realized. The signal sampling circuit 20 with a time constant circuit has a signal voltage sampling capacitor 3 and a time constant resistor 21 which is connected in parallel to the signal voltage sampling capacitor 3.

Figure 4:
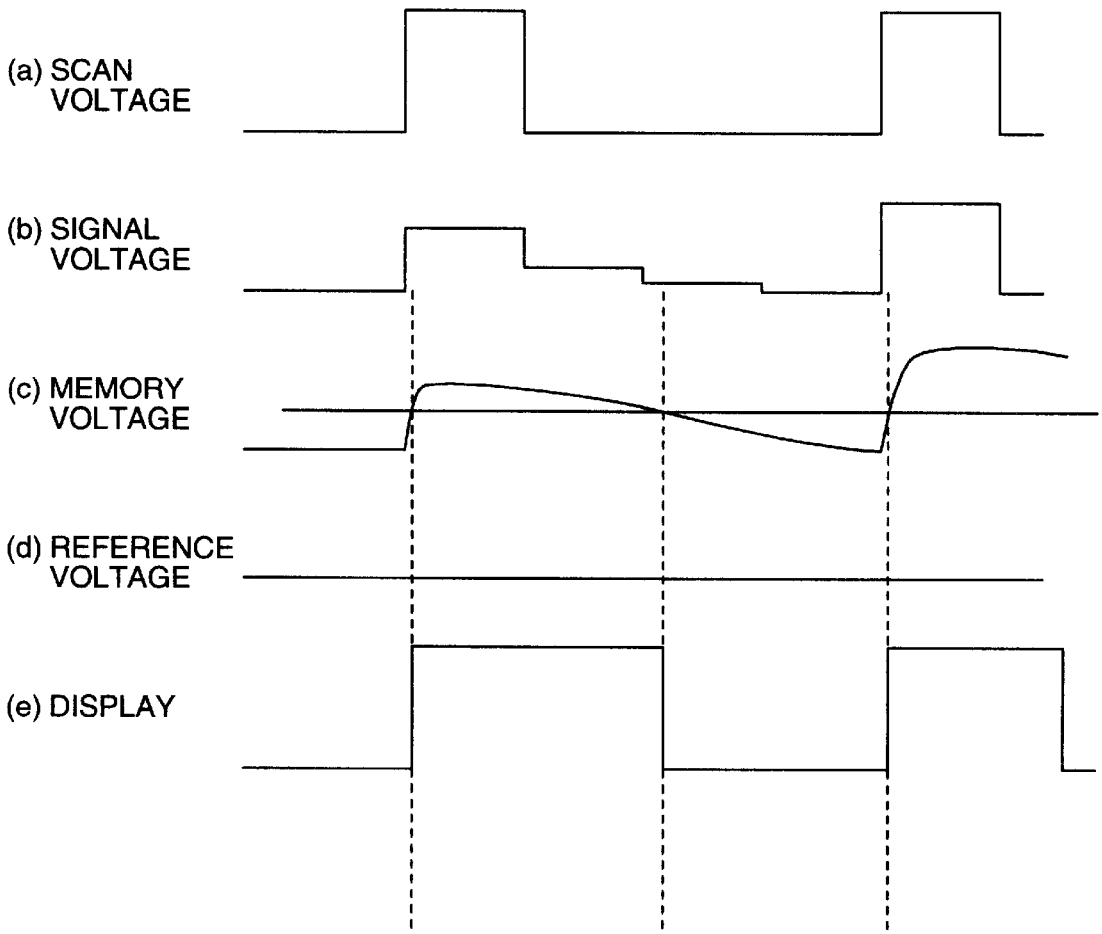
FIGS. 4(*a*) to 4(*e*) are diagrams showing the waveforms of signals driving the pixel circuit of the second embodiment.

FIGS. 4(*a*) to 4(*e*) show the waveforms of signals driving the pixel circuit. The time constant circuit is set to about 16 msec which is equal to the frame time. The capacitor 3 used in the pixel circuit and having an area of 200 $\mu$m square is 13 pF, assuming that an $SiO_2$ gate insulating film is 100 nm in thickness which corresponds to 0.345 Ff/$\mu m^2$. Since the time constant resistor 21 is required to have a high resistance value of about 1.3 G ohm, a resistor made of Si is suitable.

With this pixel circuit, since the time constant circuit is built in, the sampled memory voltage discharges after the termination of the selection period. The memory voltage, therefore, lowers exponentially. When it takes a reference voltage or lower, the comparator output is inverted. Accordingly, OLED turns on at the start of scanning and turns off after a predetermined time lapse.

The light emission time of each pixel can be controlled in accordance with a signal voltage. During the display period, light is emitted at the same time when the scan pulse is applied to each scan line. The light emission time can be controlled in the range from the scan start timing to any time in one frame period. Considerably different from the first embodiment, all the frame time may be used as the light emission time.

In contrast, in the first embodiment, the frame period is constituted of the selection time for writing a signal voltage in each pixel and the display time for light emission. The display luminance is obtained by averaging the luminance with time. Therefore, in order to obtain the same luminance, it is necessary to emit light by taking into consideration the selection time and light emission time. It is necessary to flow a correspondingly large current into OLED.

According to the second embodiment, low power and long life are possible. Although light emission generally starts when the scan voltage is applied, in order to display perfect "black" data, the signal voltage is set lower than the reference voltage so as not to emit light. In this manner, a high contrast ratio can be obtained. If a display with the highest luminance is to be made, the signal voltage is set high so that the memory voltage maintains equal to or higher than the reference voltage even after one frame period.

A luminance of a specific area can be raised for a so-called peak luminance display of a CRT in a fine area. An image with high contrast and high distinction can be displayed. Since the OLED power supply wiring line is driven separately for each scan line, the OLED drive voltage may be raised during only a portion of the frame period to realize a peak luminance display. In this case, the OLED drive voltage having a different waveform for each scan line is applied.

(3rd Embodiment)

Figure 5:
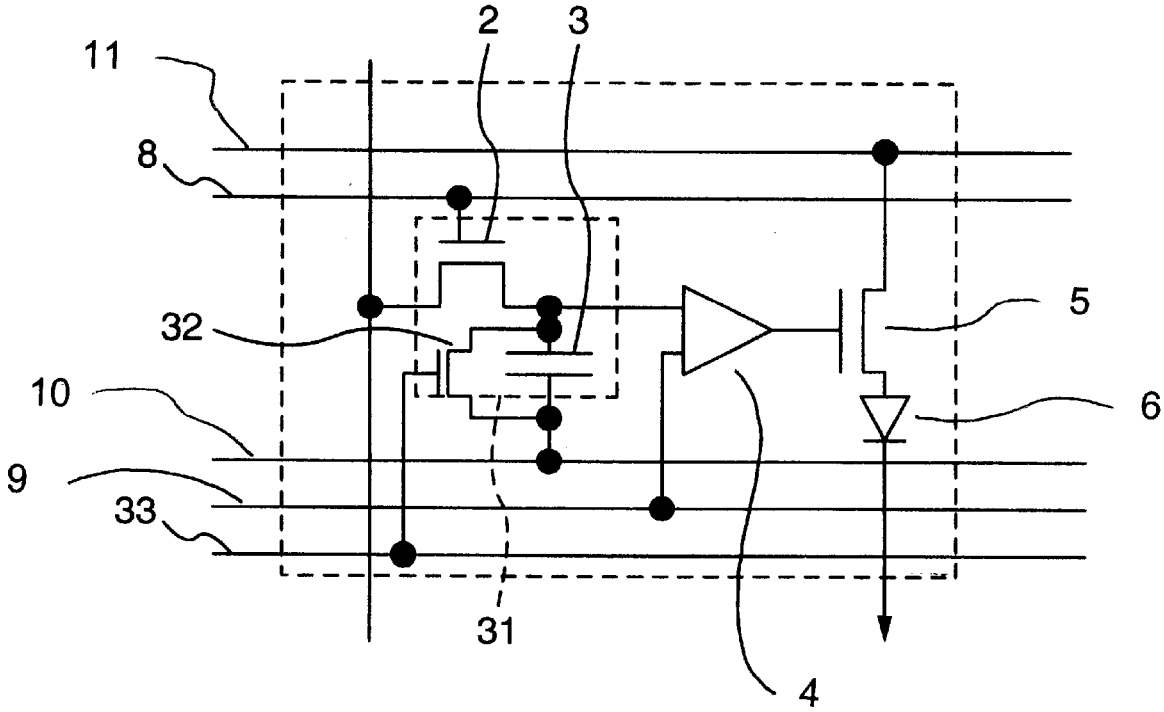
FIG. 5 is a circuit diagram showing the structure of a pixel circuit with a discharge TFT according to a third embodiment of the invention.

Next, the third embodiment will be described with reference to FIG. 5. In this embodiment, a discharge transistor 32 for discharging a memory voltage and a discharge control voltage 33 is added to the second embodiment. After the pixel selection period, a discharge control voltage is applied to discharge the memory capacitor 3 via the discharge transistor 32 to change the memory voltage.

Figure 6:
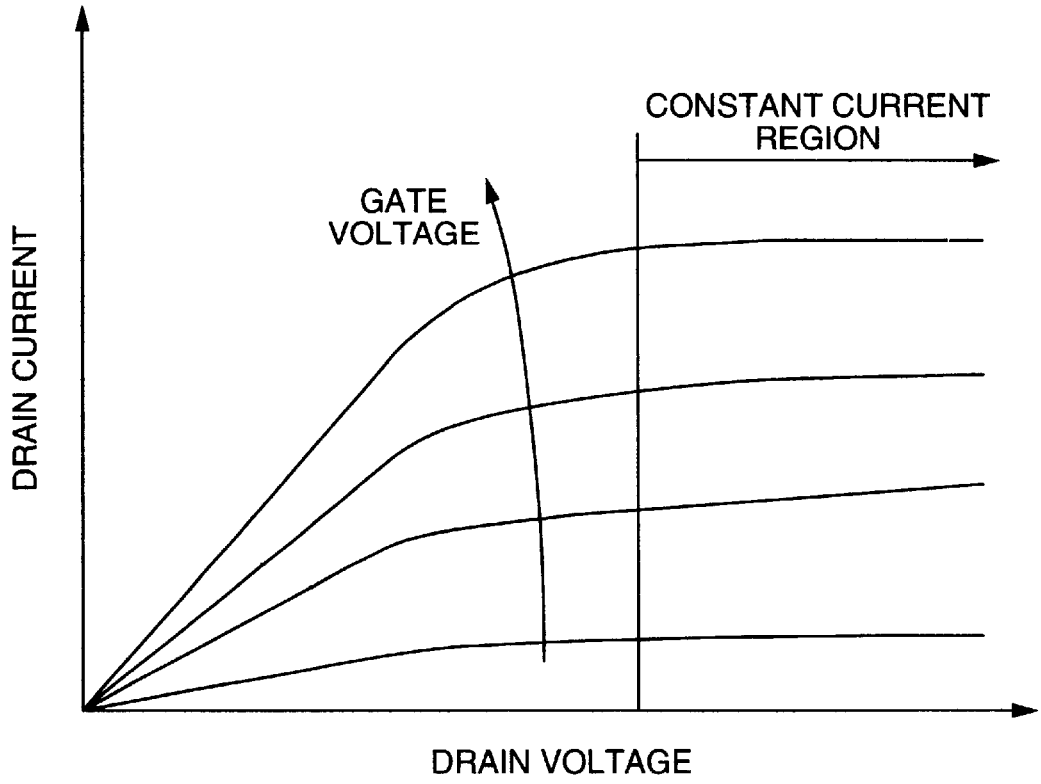
FIG. 6 is a graph showing the constant current characteristics of TFT.

As shown in FIG. 6, the drain voltage of a transistor 32 has constant current characteristics in the non-saturation region, irrespective of the drain voltage, so that voltage-time conversion of high linearity is possible. It is preferable to connect the comparator 4 so that OLED turns on when the signal voltage is higher than the reference voltage. If the discharge transistor 32 is made of TFT, the off-current can be lowered by serially connecting the transistor 32 or making the gate length longer than the gate width. In this manner, a long discharge time constant of approximately a frame period can be obtained.

(4th Embodiment)

Figure 7:
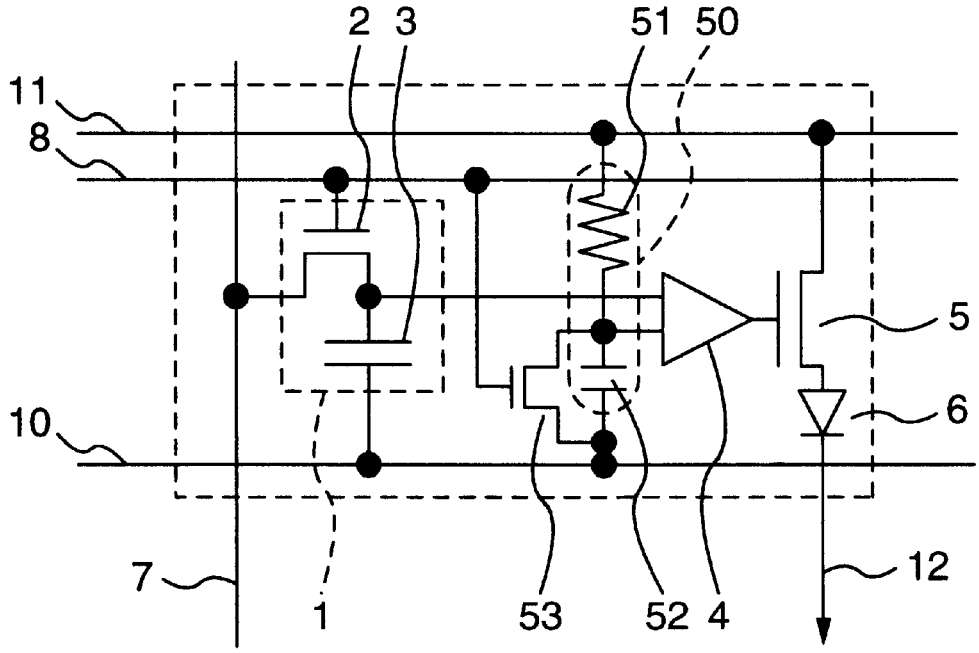
FIG. 7 is a circuit diagram showing the structure of a pixel circuit with a reference voltage discharge circuit according to a fourth embodiment of the invention.

Next, the fourth embodiment will be described with reference to FIG. 7. The feature of this embodiment reside in that a time constant circuit is coupled to a reference voltage to make the capacitor discharge in response to the scan pulse and generate a signal whose waveform changes with time, and the emission time is controlled by comparing the sampled signal voltage with the time changing voltage. The time constant circuit 50 is made of a resistor 51 and a capacitor 52 connected between the reference voltage wiring line 11 and a ground wiring line 10. A discharge transistor 53 is connected in parallel to the capacitor 52 whose gate is connected to the scan wiring line 8.

Figure 8:
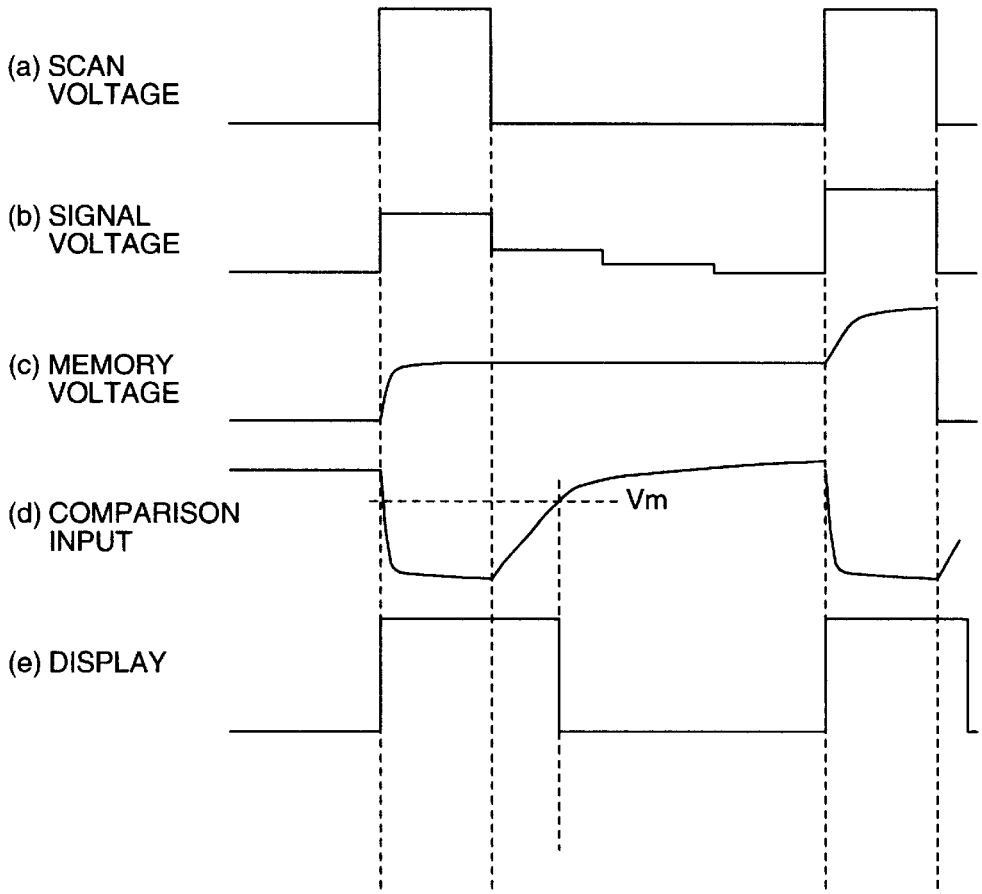
FIGS. 8(*a*) to 8(*e*) are diagrams showing the waveforms of signals driving the pixel circuit of the third embodiment.

FIG. 8 shows the waveforms of signals driving the pixel circuit. When the scan pulse is applied, the comparison input voltage corresponding to the capacitor voltage of the time constant circuit 50 is reset to the ground potential and the comparator output is reset. At the same time when the scan pulse is removed, the reference voltage is applied via the resistor 51 so that the voltage of the capacitor rises. This voltage and signal voltage are applied to the comparator. When the comparison voltage exceeds the memory voltage Vm, the output of the comparator 4 is changed.

OLED is controlled to emit light only during the period while the comparator output is reset. Therefore, as shown in FIGS. 8(*a*) to 8(*e*), OLED turns on at the same time when the scan pulse is applied, and it turns off at a predetermined time in the frame period. In order to stop and suppress unnecessary light emission during the scan period, the OLED power supply voltage is set equal to or lower than the light emission threshold value during the period longer than the shortest scan selection period.

(5th Embodiment)

Figure 9:
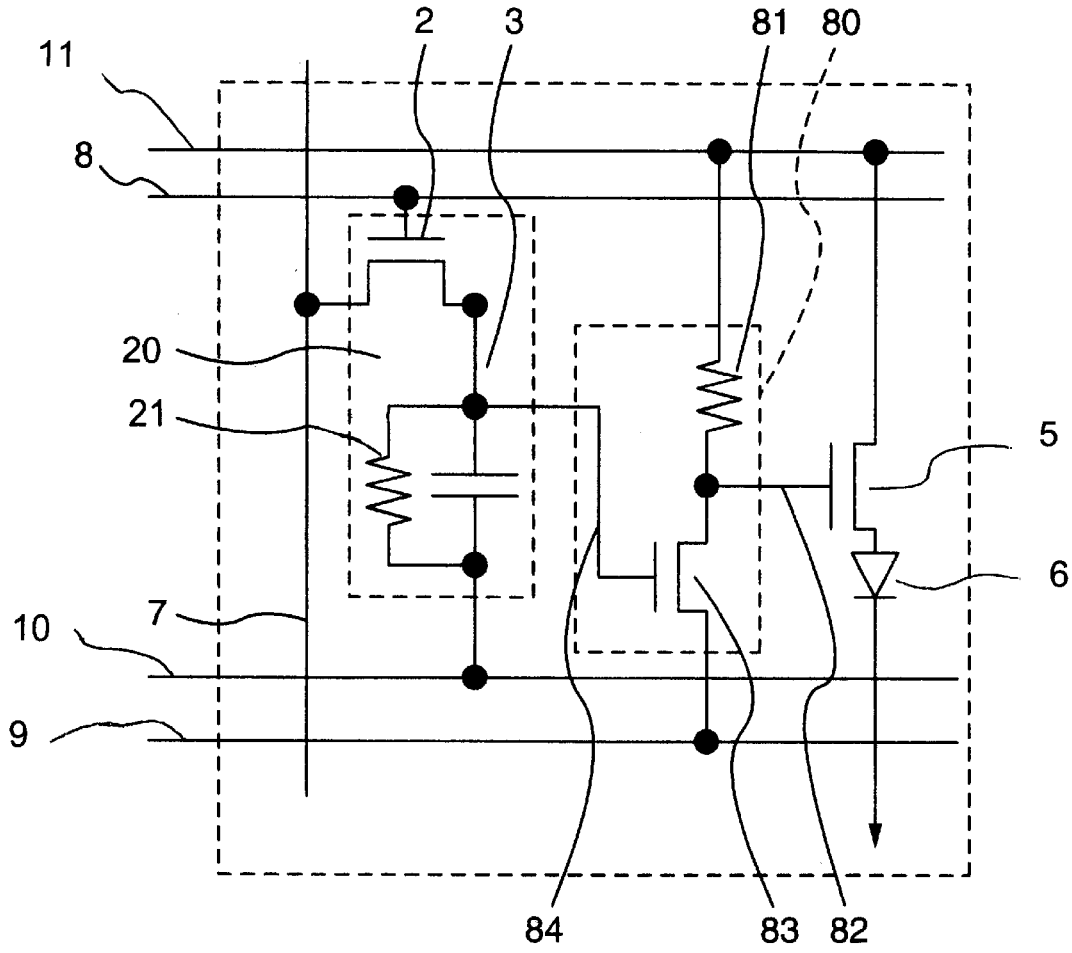
FIG. 9 is a circuit diagram showing the structure of a pixel circuit with a single-TFT comparator circuit according to a fifth embodiment of the invention.

The fifth embodiment is shown in FIG. 9. The feature of this embodiment resides in that a time constant circuit is connected in parallel to the signal voltage capacitor 3 to change the retained memory voltage and a comparator circuit 80 made of one transistor is used.

In this embodiment, since the gate electrode and source electrode of the comparator transistor 83 are used as its input terminals, they are coupled to the memory voltage and reference voltage wiring lines. The drain terminal is connected via a load resistor 81 to the OLED power supply wiring line 11. When the gate voltage becomes higher than the drain voltage, the comparator transistor 83 turns on and the output terminal 82 takes the reference voltage. When the gate voltage becomes lower than the source voltage, it turns off so that the output terminal takes the OLED power supply voltage. In this manner, the comparator transistor 83 is provided with a comparator function. With the connection of this embodiment, while the memory voltage is higher than the reference voltage, the comparator output takes the reference potential so that the OLED driver circuit 5 turns on to make OLED emit light.

With this circuit, the high impedance gate terminal of the transistor 83 is used as the input terminal of the memory voltage so that an output of the high impedance sampling circuit can be supplied without a voltage variation. Further, since the resistor 81 is connected to the drain terminal, the threshold value characteristics are not adversely affected even if the OLED power source voltage changes. Still further, if a MOS diode is connected serially between the gate terminal and memory voltage, the threshold voltage of the transistor 83 can be adjusted so that the precision of the comparator circuit 80 can be improved. The reason for this is as follows. The conduction of the comparator circuit 80 is controlled by Vgs of the transistor 83, i.e., by Vgs>threshold value Vth. By inserting a MOS diode, the gate terminal can be biased by a voltage Vth.

The resistor 81 connected to the drain terminal is a load resistor. If this resistor 81 has a high resistance value, the sensitivity of the comparator circuit 80 is raised. This is because the gain of the comparator circuit 80 is dependent upon the load resistor 81, and as the resistance is higher, a change in the drain current to be caused by the potential difference between the gate and source can be picked up as a larger voltage change. The resistor may be made of a metal thin film or an Si film, or more preferably an Si film having a low impurity concentration.

In place of the resistor 81, a diode may by used to obtain similar advantages. This diode may be a transistor with its drain and gate being connected, or a pin diode made of p-type semiconductor, an i-layer (intrinsic layer) and n-type semiconductor. These diodes can be formed by TFT processes and have non-linear voltage-current characteristics and a high resistance of 10 M ohm or higher (in contrast, a doped silicon thin film is only several k ohm), so that a high sensitivity comparator can be formed.

(6th Embodiment)

Figure 10:
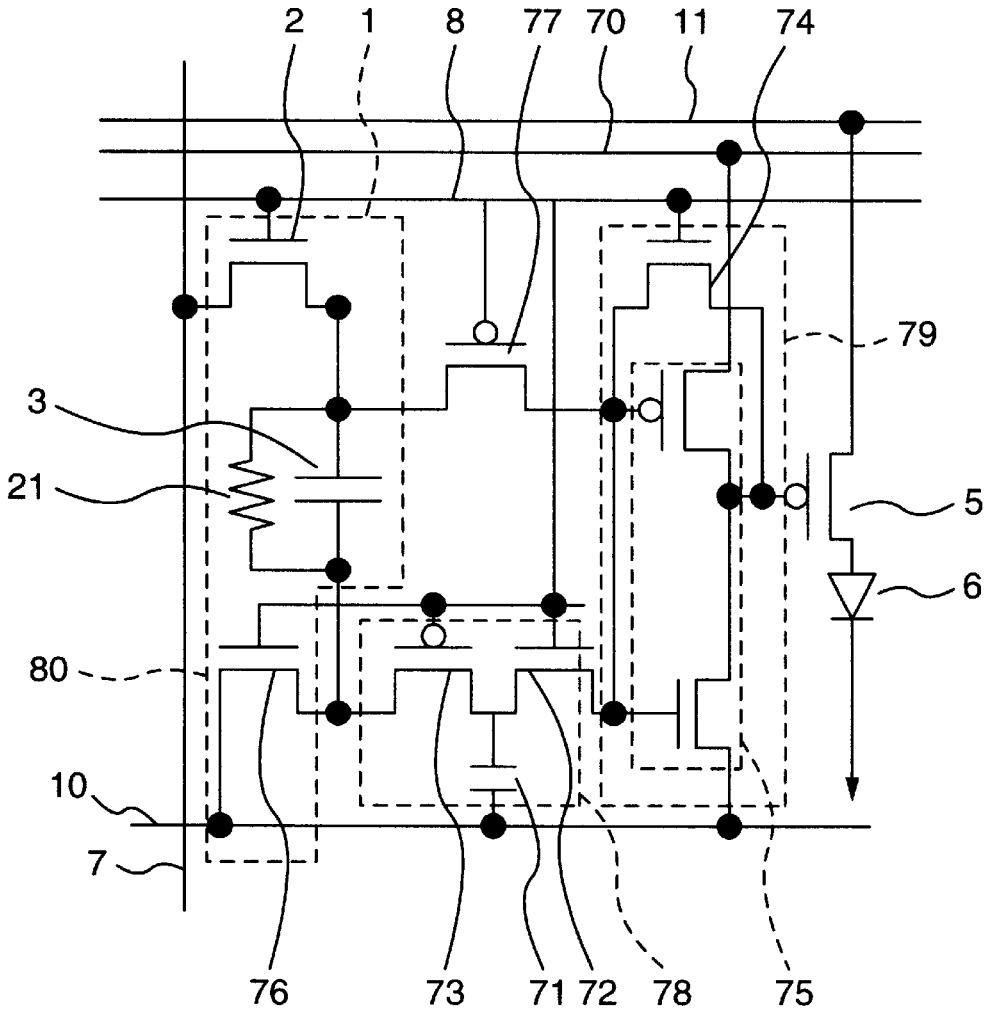
FIG. 10 is a circuit diagram showing the structure of a pixel circuit with a two-TFT comparator circuit according to a sixth embodiment of the invention.

Next, the sixth embodiment will be described with reference to FIG. 10. The feature of this embodiment resides in that an inverter circuit 75 is used as a comparator circuit 79 and that an initializing unit for shorting the circuit between input and output terminals, i.e., a reset mechanism, is provided in order to compensate for a variation in the input/output characteristics to be caused by a variation in transistor characteristics. Another feature resides in that a reset voltage sampling circuit 78 is provided for storing as the threshold voltage the input voltage equal to the output voltage of the inverter circuit 75 in the reset state.

The comparator circuit 79 is constituted of an inverter circuit 75 made of a pair of CMOS transistors and an initializing transistor 74 for connecting the input and output terminals of the inverter circuit 75. The reset voltage sampling circuit 78 for sampling input/output voltages which are equal in the reset state of the inverter circuit 75, samples the input voltage to the inverter circuit 75, and is constituted of a reference voltage retaining capacitor 71, a reset transistor 72 having its main circuit connected between the inverter input terminal and the reference voltage retaining capacitor 71, and a serial control transistor 73 connected between the reference voltage retaining capacitor 71 and one end of the signal voltage sampling capacitor 3.

The signal voltage memory circuit is connected to an input switch transistor 77 whose main circuit is connected to one end of a signal voltage sampling capacitor 3, and a common switch transistor 76 connected to the other end of the signal voltage sampling capacitor 3 and a common wiring line 10.

The gate terminals of the initializing transistor 74 reset transistor 72, input switch transistor 77, common switch transistor 76, and serial control transistor 73 are connected in common to the scan wiring line 8. The input switch transistor 77 is of a p-type and the other transistors are of an n-type.

The output terminal of the comparator circuit 79 is connected to a p-type OLED driver circuit 5 to drive OLED 6. The inverter power supply is connected to an inverter power supply wiring line 70 and drives the comparator circuit 79 separately from the OLED driver power supply. The threshold value of the comparator circuit 79 is therefore stabilized.

Figure 11:
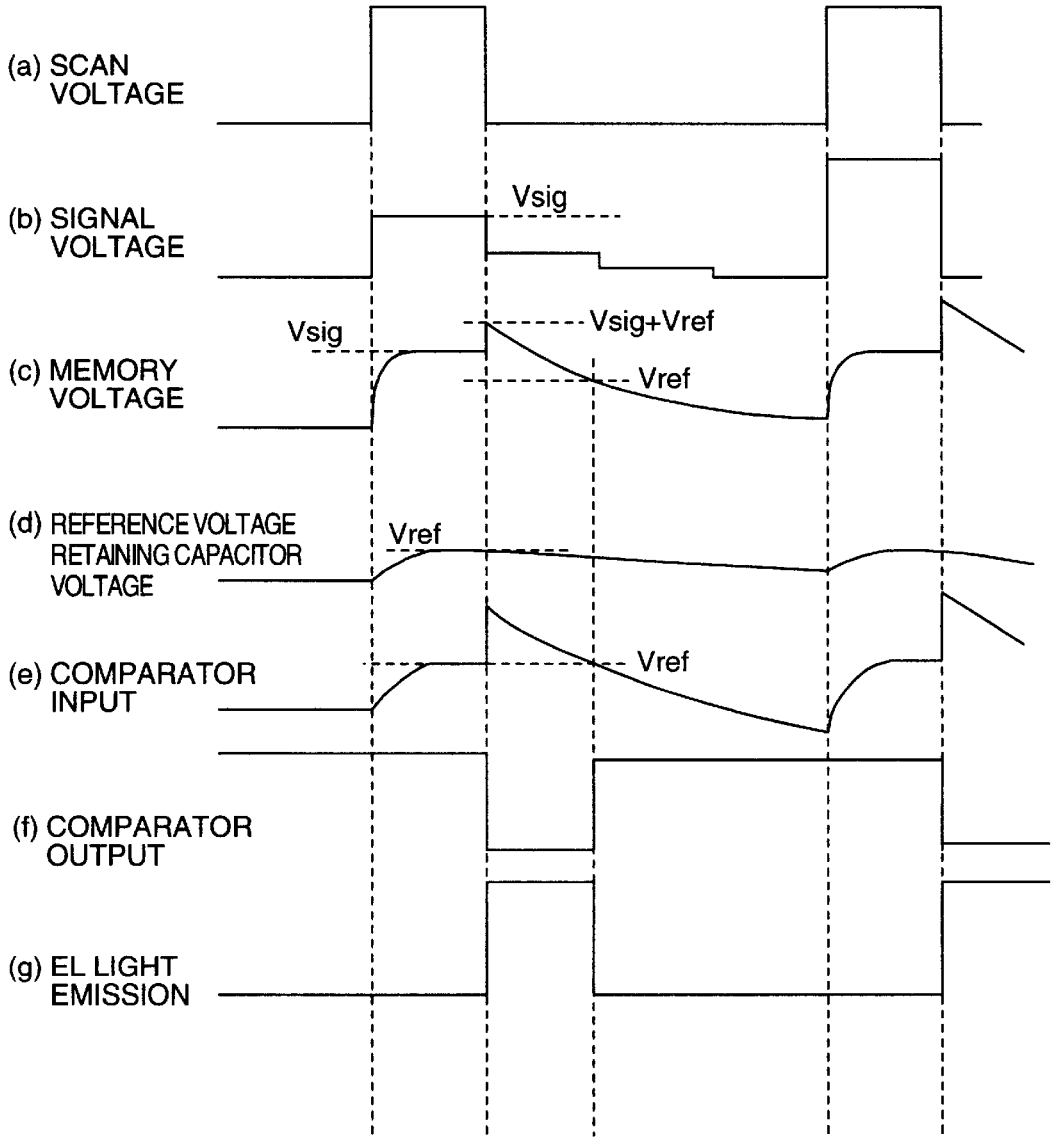
FIGS. 11(*a*) to 11(*g*) are diagrams showing the waveforms of signals driving the pixel circuit of the sixth embodiment.

The operation of this circuit will be described with reference to FIGS. 11(*a*) to 11(*g*) showing the waveforms of signals driving the pixel circuit. As a selection pulse is applied to the scan wiring line, the initializing transistor 74 turns on to short the path between the input and output terminals of the inverter circuit 75. Then, the circuit becomes stable at the reset voltage which is a voltage at the cross point of (input voltage=output voltage) on the input/output characteristic curve of the circuit. This voltage is represented by Vref in FIGS. 11(*c*) to 11(*e*). This initialized voltage charges the reference voltage retaining capacitor 71 via the reset transistor 72 in the on-state. Therefore, the voltage at the electrode of the reference voltage retaining capacitor on the transistor side is charged to Vref as shown in FIG. 11(*d*). In the signal voltage sampling circuit, since the common transistor 76 is in the on-state, the signal voltage Vsig shown in FIG. 11(*b*) is written in the signal voltage sampling capacitor and held therein.

After the pixel selection period, the initializing transistor 74, reset transistor 72, input switch transistor 77 and common switch transistor 76 enter the off-state so that the serial control transistor 73 turns on. Therefore, the reference voltage retaining capacitor 71 and signal voltage sampling capacitor 3 are serially connected. The addition of the voltages across the capacitors 71 and 3 is supplied to the input terminal of the comparator. The input voltage to the comparator has a value of Vref+Vsig as shown in FIG. 11(*c*). Since this input voltage is higher than the threshold voltage of the inverter, the output of the comparator takes an "L" level. At this time, the OLED driver transistor turns on to drive and turn on the EL device.

The signal voltage discharges through the time constant resistor 21 and lowers toward the common voltage. As the voltage lowers and becomes lower than the reset voltage Vref as shown in FIG. 11(*c*), the inverter output is inverted and changed from "L" to "H" to turn off OLED. The period from turn-on to turn-off can be controlled by the value Vsig so that gray scale display is possible.

With this circuit, even if the threshold value of a transistor changes with each pixel, the threshold value of the comparator is always maintained constant because a proper reset voltage is generated for each pixel. Even if a temperature changes or the element characteristics change by a secular change, an optimum reset voltage can be obtained always. With the circuit described above, a correct gray scale display can be obtained over the whole screen area.

(7th Embodiment)

Figure 12:
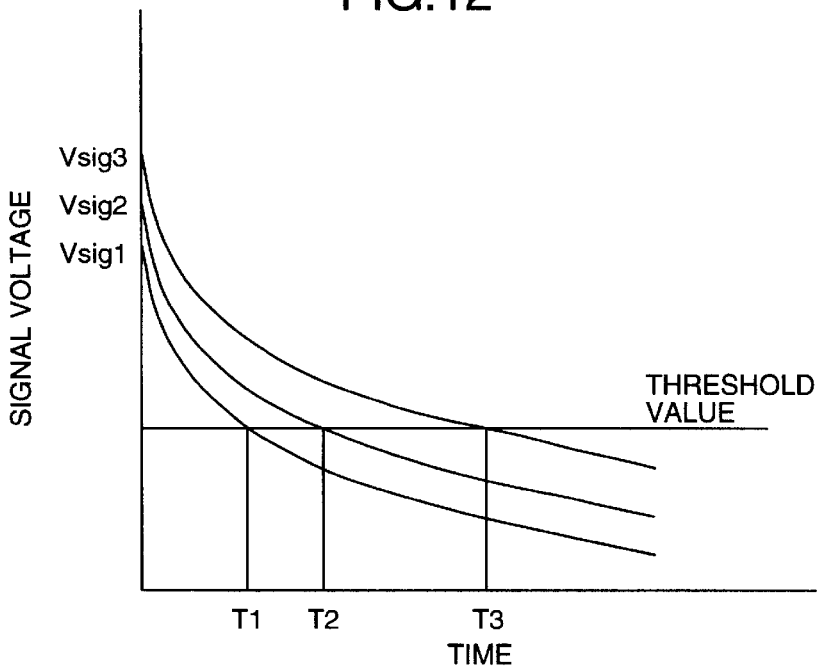
FIG. 12 is a graph showing the relation between an applied voltage and a light emission time.

In forming a display device by utilizing the pixel circuits described above, it becomes necessary to control a light emission time in proportion with a video signal. An analog video signal used by a television or the like is multiplied by a gamma coefficient matching phosphor of a CRT. A time constant circuit of CR or the like is used in the pixel circuit of each embodiment so that an applied voltage and a light emission time are not in proportion with each other. Therefore, as shown in FIG. 12 light emission times proportional to the signal voltages Vsig1, Vsig2 and Vsig3 cannot be obtained if the video signals are simply amplified and shifted. To solve this, an input video signal is supplied to a non-linear video signal conversion circuit to convert it into a converted signal voltage which is then applied to the pixel circuit of each embodiment.

Specific signal processing will be described. In a sampling circuit including a time constant circuit made of a capacitor C and a resistor R, a voltage Vmem after time t across the capacitor C is given by:

$$Vmem=Vsig\times\exp(-1/CR) \quad (1)$$

where Vsig is a signal voltage and Vref is a threshold value of a comparator.

A time tsel taken for Vmem to become Vref is obtained by solving the following equation (2) with respect to t:

$$Vmem=Vref=Vsig\times\exp(-t/CR) \quad (2)$$

Figure 13:
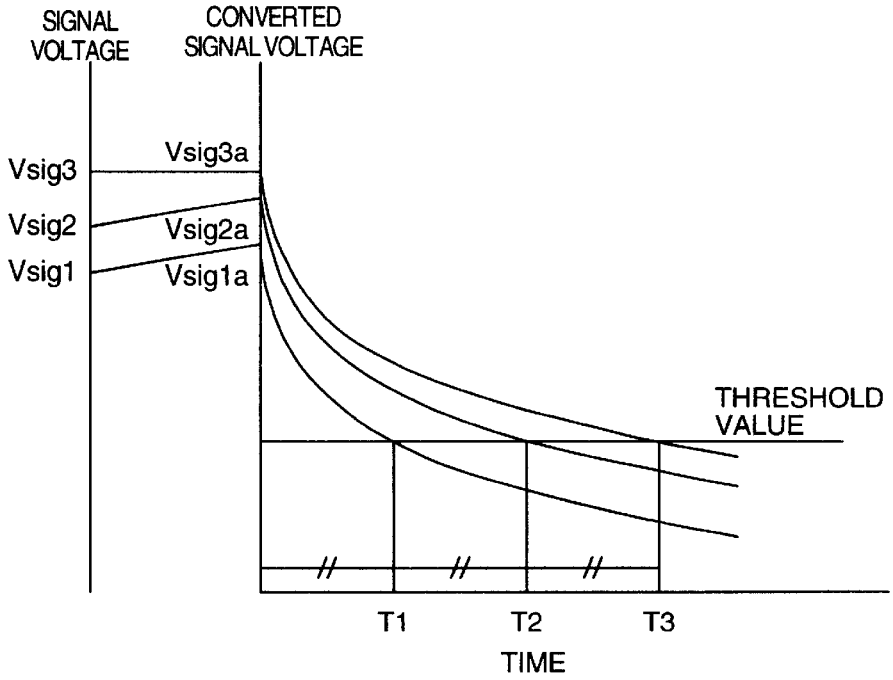
FIG. 13 is a graph showing the relation between a video signal and a light emission time according to a seventh embodiment.

Namely, converted signal voltages can be obtained through non-linear conversion corresponding to an inverse function of a time function of a memory voltage in the pixel circuit. Vsig is converted so that a proportional relation between Vsig and t is established. With this conversion, as shown in FIG. 13, the video signal becomes proportional to a light emission time and a correct gray scale display can be obtained. This conversion can be realized by using a non-linear circuit. More specifically, a logarithmic conversion of the equation (2) becomes the following equation (3):

$$CR(ln(Vsig)-(ln(Vref))=t \quad (3)$$

The input signal voltage is multiplied by a logarithmic function to obtain Vdrv=exp(Vsig). This results in a proportion of t of the equation (3) to Vsig. If Vref is set to 0 V, an error can be reduced further.

Figure 14:
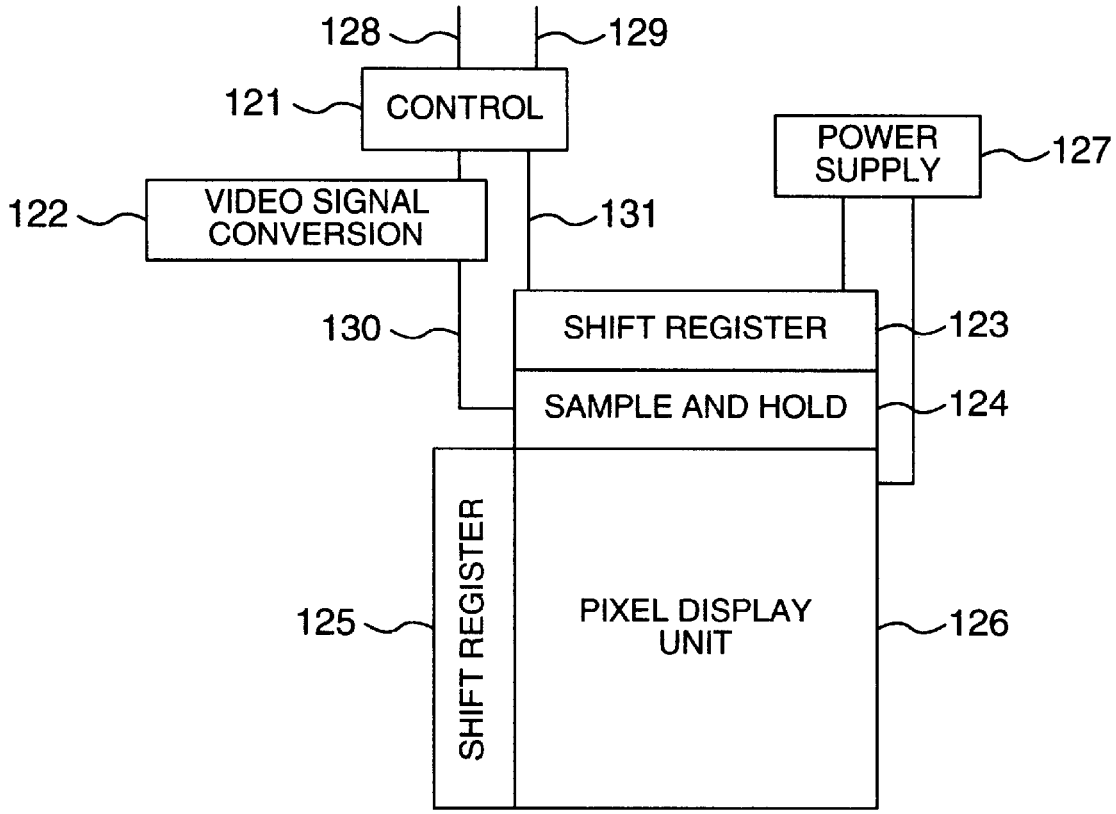
FIG. 14 is a block diagram showing the structure of a display device according to the seventh embodiment.

FIG. 14 shows the structure of a display device including a video signal conversion circuit 122 which performs the above-described signal processing. A pixel display unit 126 has a shift register circuit 125 connected to scan lines, a sample and hold circuit 124 connected to signal lines, and a shift register circuit 123 necessary for serial-parallel signal conversion, respectively disposed as shown in FIG. 14. The video signal conversion circuit 122 processes an externally input video signal 128 which is then applied to the pixel display unit via the sample and hold circuit 124. This panel is supplied with necessary power from a power supply circuit.

Even if there is a variation in the transistor characteristics of each pixel, the same light emission characteristics can be obtained for the same signal voltage. With the newly added video signal conversion circuit, a display image proportional to video signals input to the display device can be obtained and a correct gray scale display uniform over the whole screen can be obtained.

What is claimed is:

1. A display device including a pixel surrounded by wiring lines, said pixel being applied with a reference voltage supplied from a reference voltage line which is one of said wiring lines, wherein:

said pixel is provided with a sampling circuit, a voltage converter circuit, a voltage comparator circuit and an organic EL driver circuit;

said sampling circuit fetches a signal voltage on a signal line which is one of said wiring lines as a sampled voltage controlled by a voltage on a scan line which is one of said wiring lines;

said voltage converter circuit converts the sampled voltage into a voltage waveform varying with time;

said voltage comparator circuit compares the voltage waveform converted from the sampled voltage with the reference voltage to generate a control voltage output changing when a sign of subtraction between the compared voltages is inverted; and said organic EL driver circuit controls turn-on/turn-off of an organic EL element in said pixel in accordance with the control voltage output.

2. A display device including a pixel surrounded by wiring lines crossing each other, said pixel being applied with a reference voltage supplied from a reference voltage line which is one of said wiring lines, wherein:

said pixel is provided with a sampling circuit, a voltage comparator circuit, and an organic EL driver circuit;

said sampling circuit fetches a signal voltage on a signal line which is one of said wiring lines as a sampled voltage controlled by a voltage on a scan line which is one of said wiring lines, the sampled voltage being processed to vary with time and provided in said pixel;

said voltage comparator circuit compares the sampled voltage with the reference voltage to generates a control voltage output changing when a sign of subtraction between the compared voltages is inverted; and said organic EL driver circuit controls turn-on/turn-off of an organic EL element in said pixel in accordance with the control voltage output.

3. A display device according to claim 2, wherein said voltage comparator circuit is a differential input comparator arranged to compare the sampled voltage with the reference voltage and generate the control voltage output.

4. A display device according to claim 2, wherein thin film transistors (TFTs) are used as active elements in said sampling circuit and said organic EL driver circuit, and said voltage comparator circuit has input terminals coupled to receive the sampled voltage and the reference voltage, via a voltage adjusting circuit, for generating the control voltage output indicating a difference between the sampled voltage and the reference voltage.

5. A display device according to claim 4, wherein said voltage adjusting circuit is made of a capacitor and a thin film transistor.

6. A display device according to claim 2, wherein:

the sampled voltage is set to change with time so that the sign of subtraction between the sampled voltage and the sampled signal voltage is inverted; and the organic EL element in said pixel is turned on during a time duration from the start of the period to the inversion or from the inversion to the start of a next period to thereby control a display luminance during the period.

7. A display device according to claim 1, wherein said voltage comparator circuit comprises an inverter circuit and initializing means for shortening output and input terminals of the inverter circuit, and has a function of holding an output voltage during the shortening operation to superpose the output voltage upon the sampled voltage.

8. A display device according to claim 1, wherein said voltage comparator circuit comprises an inverting amplifier circuit and initializing means for shortening output and input terminals of the inverting amplifier circuit, and has a function of holding an output voltage during the shortening operation to superpose the output voltage upon the sampled voltage.

9. A display device according to claim 1, wherein said voltage comparator circuit comprises at least one transistor, gate and source terminals thereof are used as input terminals, one input terminal is supplied with the sampled voltage or sampled signal voltage, and the other input terminal is supplied with the reference voltage or the pixel reference voltage.

10. A display device according to claim 1, wherein said voltage comparator circuit comprises at least one transistor, gate and source terminals thereof are used as input terminals, the gate terminal is supplied with the sampled signal voltage, and the source terminal is supplied with the reference voltage or the pixel reference voltage.

11. A display device according to claim 1, wherein said voltage comparator circuit is an amplifier circuit including at least one transistor, a gate terminal is supplied with the sampled signal voltage, a source terminal is supplied with the reference voltage or the pixel reference voltage, and a drain terminal is connected to a resistor load or a diode load.

12. A display device according to claim 9, wherein one of a plurality of input terminals of said voltage comparator circuit is supplied with the sampled voltage or the sampled signal voltage, and another is supplied with the reference voltage or the pixel reference voltage, at least one input terminal is supplied with the voltage via a capacitor.

13. A display device including a pixel surrounded by wiring lines crossing each other, said pixel being applied with a reference voltage supplied on a reference voltage line from said wiring lines, wherein:

said pixel is provided with a sampling circuit, a voltage comparator circuit, and an organic EL driver circuit;

said sampling circuit fetches a signal voltage on a signal line from said wiring lines as a sampled voltage controlled by a voltage on a scan line from said wiring lines, and said sampling circuit includes a sampled voltage processing circuit for changing the sampled voltage toward a reference voltage on the reference voltage line from said wiring lines with time;

said voltage comparator circuit compares the reference voltage on the reference voltage line with the sampled voltage to generate a control voltage output changing with an inversion of a sign of subtraction between the reference voltage and the sampled voltage; and said organic EL driver circuit controls switching of an organic EL element in said pixel in accordance with the control voltage output.

14. A display device according to claim 13, wherein:

said sampling circuit is made of at least a sampling transistor connected to the scan line and the signal line, and a sampling capacitor connected to said sampling transistor and a common line from said wiring lines.

15. A display device according to claim 13, wherein:

said sampled voltage processing circuit is a current control circuit made of one or more capacitors including the sampling capacitor, a resistor and a transistor.

16. A display device including a pixel surrounded by wiring lines crossing each other, said pixel being applied with a reference voltage supplied on a reference voltage line from said wiring lines, wherein:

said pixel is provided with a signal voltage sampling circuit, a reference voltage sampling circuit, a voltage comparator circuit, and an organic EL driver circuit;

said signal voltage sampling circuit fetches a signal voltage on a signal line from said wiring lines as a sampled signal voltage controlled by a voltage on a scan line from said wiring lines, the sampled signal voltage being processed to vary with time and provided in said pixel;

said reference voltage sampling circuit samples the reference voltage on the reference voltage line as a sampled reference voltage which is converted into a pixel reference voltage;

said voltage comparator circuit compares the pixel reference voltage with the sampled reference voltage to generate a control voltage output changing when a sign of subtraction between the compared voltages is inverted; and said organic EL driver circuit controls turn-on/turn-off of an organic EL element in said pixel in accordance with the control voltage output.

17. A display device according to claim 16, further comprising a reference voltage processing circuit provided to invert a polarity of the reference voltage to calculate an addition voltage with the reference voltage.

18. A display device according to claim 17, wherein said reference voltage processing circuit is a sampling circuit made of a reference voltage sampling capacitor and a transistor connected between the reference voltage line and the reference voltage sampling capacitor, or serially inserting a sampled reference voltage between the reference voltage line and the voltage comparator circuit to thereby calculate an addition voltage therebetween.

19. A display device including a pixel surrounded by wiring lines crossing each other, said pixel being applied with a reference voltage supplied on a reference voltage line from said wiring lines, wherein:

said pixel is provided with a signal voltgage sampling circuit, a reference voltage sampling circuit, a voltage comparator circuit, and an organic EL driver circuit;

said signal voltage sampling circuit fetches a signal voltage on a signal line from said wiring lines as a sampled signal voltage controlled by a voltage on a scan line from said wiring lines;

said reference voltage sampling circuit samples the reference voltage on the reference voltage line as a sampled reference voltage which is converted into a pixel reference voltage;

said voltage comparator circuit compares the sampled reference voltage with the pixel reference voltage to generate a control voltage output changing when a sign of subtraction between the sampled reference voltage and the pixel reference voltage is inverted; and said organic EL driver circuit controls switching of an organic EL element in said pixel in accordance with the control voltage output.

20. A display device according to claim 19, further comprising a reference voltage processing circuit made of one or more capacitors including the reference voltage sampling capacitor and one or more resistors for changing the charge amount in the reference voltage sampling capacitor with time.

21. A display device according to claim 14, wherein the pixel reference voltage is set to change with time in each period so that the sign of subtraction between the sampled signal voltage and the reference voltage is inverted during the period, and wherein the organic EL device is turned on during the time duration from the start of the period to the inversion or from the inversion to the start of a next period to thereby control display luminance during the period.

* * * * *